United States Patent [19]

Takamatsu et al.

[11] Patent Number: 5,054,244

[45] Date of Patent: Oct. 8, 1991

[54] POLISHING APPARATUS

[75] Inventors: Hiroshi Takamatsu, Oomiya; Katsunobu Ueda, Yokohama, both of Japan

[73] Assignee: Kabushiki Kaisha Toshiba, Kawasaki, Japan

[21] Appl. No.: 509,155

[22] Filed: Apr. 16, 1990

[30] Foreign Application Priority Data

Apr. 19, 1989 [JP] Japan ..... 1-97560

[51] Int. Cl.[5] ..... B24B 49/00

[52] U.S. Cl. ..... 51/165.71; 51/165.77; 51/240 R; 269/55

[58] Field of Search ..... 51/165.71, 165.77, 26, 51/240 R; 269/55; 318/646

[56] References Cited

PUBLICATIONS

Proceeding of Japan Society of Precision Engineering (1989), 1139; H. Suzuki et al.; Mar. 24 (1989).

*Primary Examiner*—M. Rachuba

*Attorney, Agent, or Firm*—Oblon, Spivak, McClelland, Maier & Neustadt

[57] ABSTRACT

A polishing apparatus comprising a tool for polishing a surface of a workpiece, a table for supporting a workpiece, a piezoelectric element for minutely driving the table, a load detector for detecting the load applied from the tool to the workpiece supported on the table, and a load controller for controlling the drive means in accordance with the load detected by the detector. The piezoelectric element moves the table minutely in the same direction as, or the direction opposite to, the direction in which said tool applies a load to the workpiece.

8 Claims, 5 Drawing Sheets

OUTPUT VOLTAGE V1 OF LOAD CELL (V)

REFERENCE VOLTAGE V2 (V)

DIFFERENCE V1-V2 (V)

DRIVE VOLTAGE V3 (V)
0

DISTANCE OF DOWNWARD MOVEMENT (μm)

100
200
POLISHING LOAD (gf)

POLISHING APPARATUS

BACKGROUND OF THE INVENTION

1. Field of the Invention

The present invention relates to a polishing apparatus for polishing workpieces by means of a polishing tool.

2. Description of the Related Art

A variety of components having spherical surfaces and complex curved surfaces are used in various industrial fields. Some of them, such as optical lenses and X-ray reflectors, have high-precision curved mirror surfaces.

One method of forming such mirror surfaces is the high-precision polishing method, in which a soft polishing tool made of plastic or rubber is used to polish workpieces with high precision. The polishing tool can have either a concave or a convex surface. A workpiece is placed in contact with the polishing surface of the polishing tool, and is polished thereby.

Recently, an automatic high-precision polishing apparatus has been developed. This apparatus comprises an NC controller, a tool for polishing a workpiece, an electric motor for driving the tool under the control of the NC controller, and a mechanism for supporting the tool and applying a load from the work point of the tool to the surface of the workpiece, under the control of the NC controller. The NC controller controls the motor in accordance with coordinates data representing the positions which the tool must take with respect to the workpiece, thereby moving the tool to a desired position.

In order to polish the workpiece uniformly over its entire surface, it is necessary for the tool to apply a constant load from its work point to the surface of the workpiece, at all times during the polishing. The tool, however, cannot be moved so minutely as to move its work point along the peaks and depressions formed in the surface of the workpiece, which have heights and depths in the order of nanometers, and inevitably fails to apply the same load to every part of the workpiece surface. The parts of the workpiece are polished with different loads, and come to have different surface roughnesses.

SUMMARY OF THE INVENTION

The object of the present invention is to provide a polishing apparatus which can apply the same load to every part of the surface off a workpiece even if the surface of the workpiece is complicated curved, and which can therefor polish the workpiece with high precision.

According to the invention, there is provided a polishing apparatus which comprises: a tool for polishing a surface of a workpiece; a table for supporting the workpiece and minutely movable in the same direction as, or the direction opposite to, the direction in which the tool applies a load to the workpiece; an element for moving the table minutely; a detector for detecting the load which the tool applies to the workpiece; and a controller for controlling the element in accordance with the load detected by the detector.

The detector detects the load being applied from the tool to the workpiece and generates a signal representing this load, which is supplied to the controller. The controller controls the element in accordance with the load represented by the signal, and the element moves the tool in the same direction as, or the direction opposite to, the direction in which the tool applies the load to the workpiece, the load applied to the workpiece changes to a prescribed value. In other words, the heights of the peaks formed on, and the depths of the depressions formed in, the surface of the workpiece are detected in terms of changes in the load detected by the detector, and the table is moved in accordance with these changes. Hence, the tool applies the same load to ever part of the surface of the workpiece, polishing the workpiece with high precision.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention, which is a polishing apparatus, will now be described with reference to the accompanying drawings.

Figure 1:
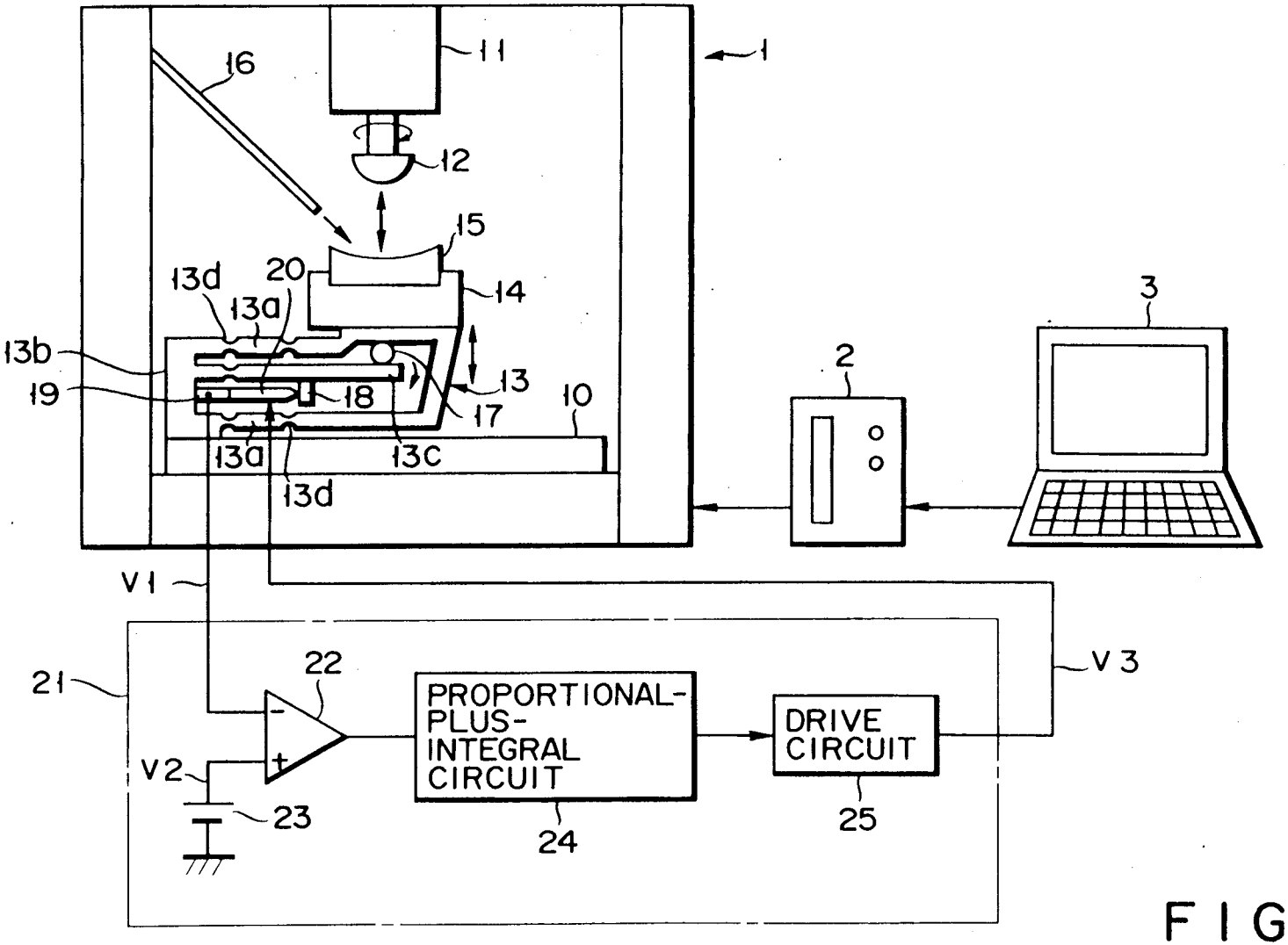
FIG. 1 is a plan view illustrating a polishing apparatus according to a first embodiment of the present invention.

As is shown in FIG. 1, the polishing apparatus comprises a polishing mechanism 1, a data buffer 2, and a personal computer 3. The mechanism 1 is designed to polish workpieces and is connected to the data buffer 2. The data buffer 2 is connected to the personal computer 3. The computer 3 has a memory storing numerical data for controlling the polishing mechanism, and can convert the numerical data to coordinates data. The data buffer 2 temporarily stores the coordinates data output by the personal computer 3.

The polishing mechanism 1 comprises a movable stage 10, a bearing 11, a polishing tool 12, a movable table 13, a holder 14, and a pipe 16. The tool 12 is supported by the bearing 11 and connected to an electric motor (not shown) located above the movable stage 10. The table 13 is attached to the top of the stage 10. The holder 14 is fixed to the table 13, for holding a workpiece 15. The pipe 16 extends downward and slantwise to the holder 14, for supplying abrasive to the workpiece 15 held by the holder 14.

The movable stage 10 can move in a horizontal plane, in the X-axis direction and the Y-axis direction, as it is driven by an electric motor (not shown) in accordance with the coordinate data stored in the data buffer 2.

The polishing tool 12 is what is generally know as "polisher," made of soft material such as pitch, plastics, or rubber. The tool 12 can move up and down together with the bearing 11, and can also rotate in the direction of the arrow shown in FIG. 1.

Figure 2:
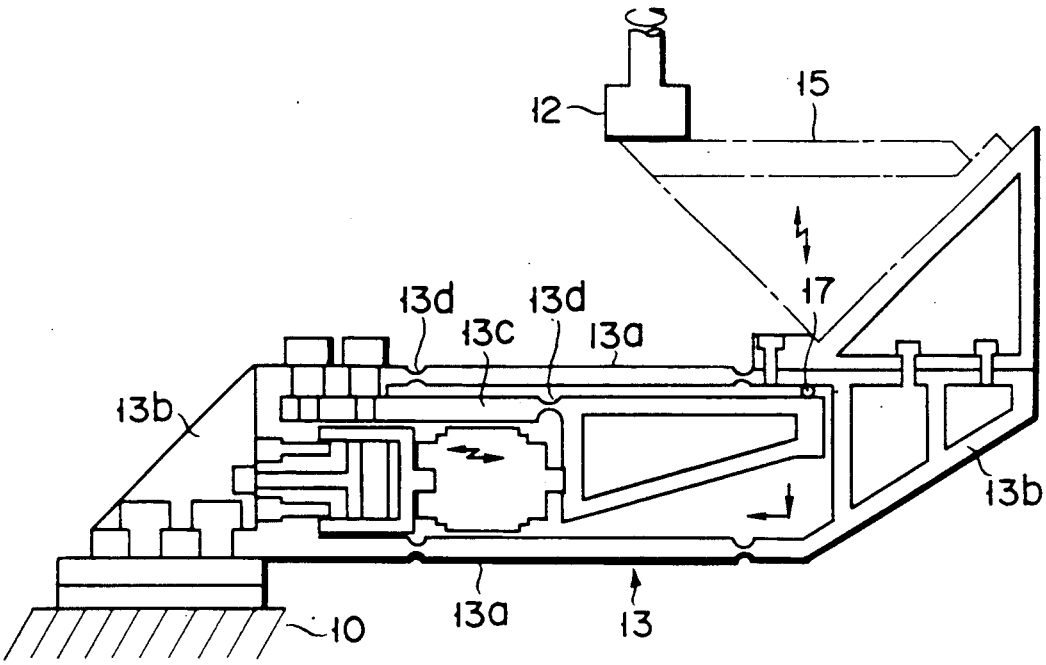
FIG. 2 is a diagram showing, in detail, the table incorporated in the apparatus illustrated in FIG. 1.

As FIG. 2 shows, the table 13 comprises two parallel-plates 13*a* made of, for example, stainless steel and located one above the other, and two side plates 13*b*, each connecting the ends of the plates 13*a*. The plates 13*a* and 13*b* form a trapezoidal frame. The first side plates 13*b* is fastened to the stage 10. The table 13 further comprises a load-magnifying plate 13*c* which is made of the same material as the plates 13*a*, is located between the plates 13*a*, and is fastened at one end to the first side plate. Each plate 13*a* has two grooves 13*d* cut in both surfaces of the same portion, so that this portion of the plate 13*a* functions as a spring. Due to the spring portions the plates 13*a*, the table 13 can move minutely up and down, or in the directions the tool 12 is moved. When the table 13 minutely moves up or down, the holder 14, which is fixed to the table 13, also moves minutely up or down.

As is shown in FIG. 1, a ball 17 is interposed between the upper plate 13*a* and the load-magnifying plate 13*c*, and a projection 18 protrudes downwards from the lower surface of the plate 13*c*. The ball 17 point-contacts the load-magnifying plate 13*c* and transmits the movement of the upper plate 13*a* to the plate 13*c*. The projection 18 has a rectangular cross section.

The polishing mechanism 1 further comprises a load cell 19 and a piezoelectric ceramic member 20. As is shown in FIG. 1, the load cell 19 and the member 20 are connected, at one end, to each other and located in the gap between the lower plate 13*a* and the load-magnifying plate 13*c*. The other end of the load cell 19 is fastened to the second side plate 13*b*, and the other end of the piezoelectric ceramic member 20 is connected to one side of the projection 18 in order to move the load-magnifying plate 13*c* minutely. Hence, a load applied from the tool 12 to the workpiece 15 held by the holder 14, the load is transmitted to the load cell 19 via the holder 14, the upper plate 13*a*, the ball 17, the load-magnifying plate 13*c*, the projection 18, and the piezoelectric ceramic member 20.

The pipe 16 is used to supply abrasive onto the surface of the workpiece 15. The abrasive is, for example, oil or aqueous solution containing particles of diamond, silicon carbide, cerium oxide ($CeO_2$).

As is shown in FIG. 1, the polishing apparatus further comprises a polishing-load controller 21 which is designed to control the piezoelectric ceramic member 20 in accordance with the polishing load detected by the load cell 19. This circuit comprises a comparator circuit 22, a DC power supply 23, a proportional-plus-integral circuit 24, and a drive circuit 25. The power supply 23 applies a refrains voltage $V_2$ which corresponds to a desired polishing load to be applied to the workpiece 15. The comparator circuit 22 compares the voltage $V_1$ output by the load cell 19 with a reference voltage $V_2$ applied from a DC power supply 23, generating a difference signal representing the difference between the voltages $V_1$ and $V_2$. The proportional-plus-integral circuit 24 performs proportional-plus-integral operation on the difference signals generated by the comparator circuit 22, and generating a signal representing the results of this operation. The drive circuit 25 converts the output signal of the circuit 24 to a drive voltage $V_3$, which is applied to the piezoelectric ceramic member 20.

It will now be explained how the polishing apparatus operates.

First, the tool 12 is positioned relative to the workpiece 15 held by the holder 14. Then, the personal computer 3 converts the numerical data required for polishing the workpiece 15, into the coordinates data required for driving the polishing mechanism 1. The coordinate data is stored into the data buffer 2. Thereafter, when an operator supplies a drive command to the polishing mechanism 1, the coordinates data is supplied to the mechanism 1 from the data buffer 2. The tool 12 is rotated and lowered until it contacts the workpiece 15. The stage 10 is moved in the X-axis direction and the Y-axis direction in accordance with the coordinate data. In the meantime, the abrasive is applied through the pipe 16 to the workpiece 15. Thus, the rotating tool 12 polishes the workpiece 15.

Figures 3A, 3B, 3C, 3D, 3E:
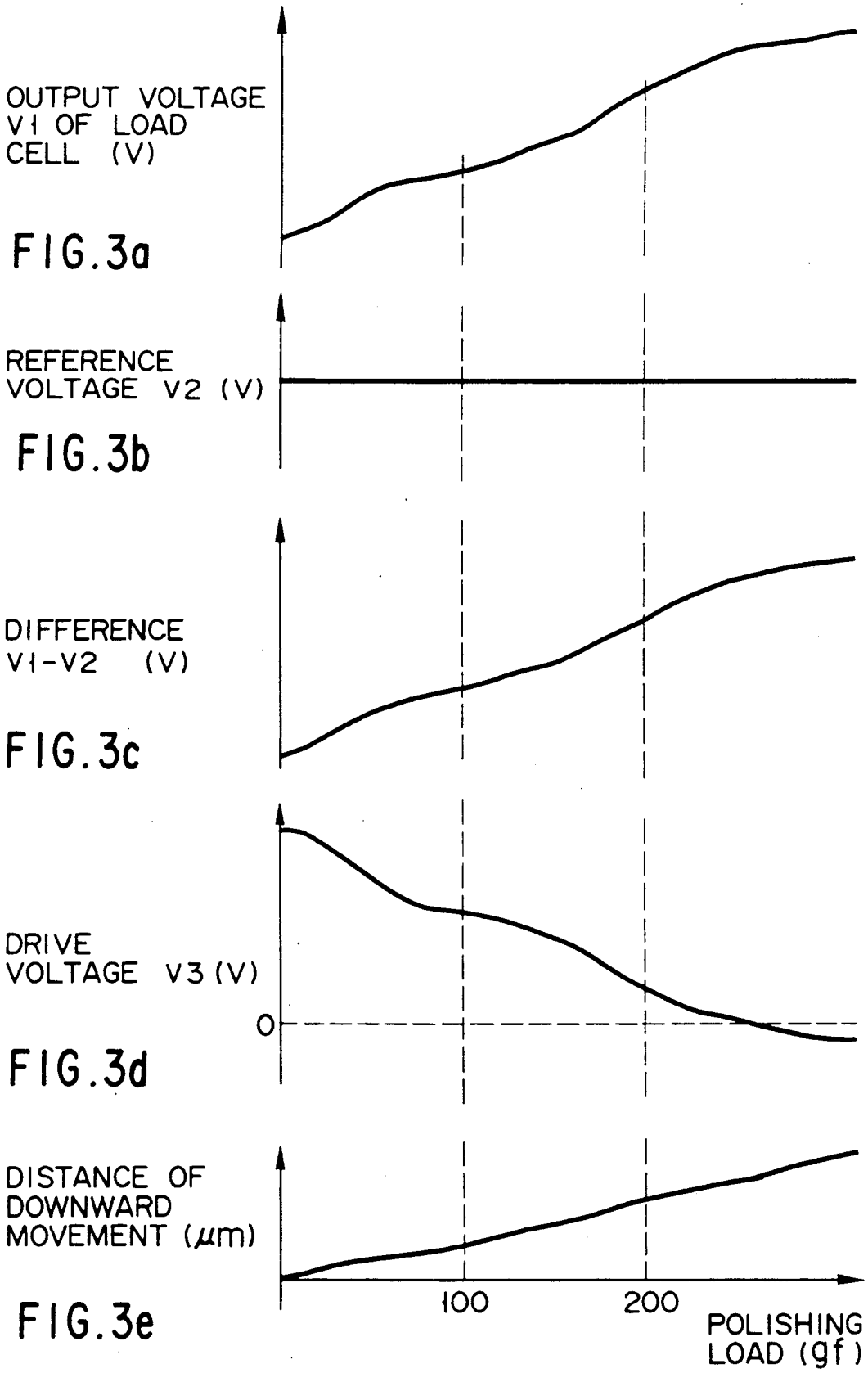
FIGS. 3*a* through 3*e* and 4*a* through 4*d* show the waveforms of various signals used in the apparatus, explaining the operation of the apparatus.
Figure 4A:
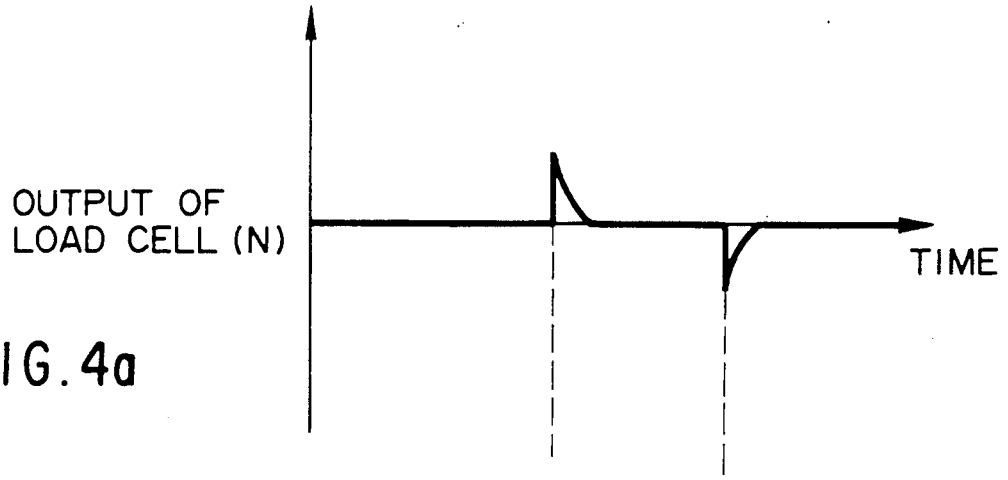
Figure 4B:
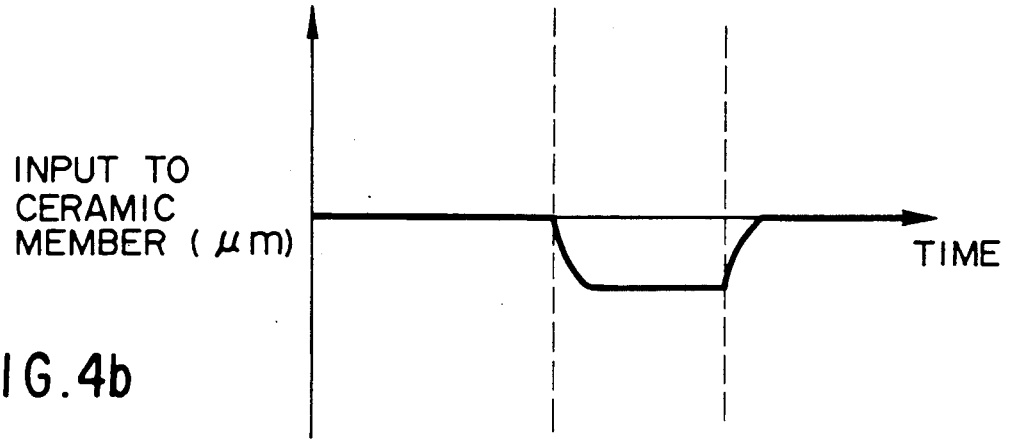
Figure 4C:
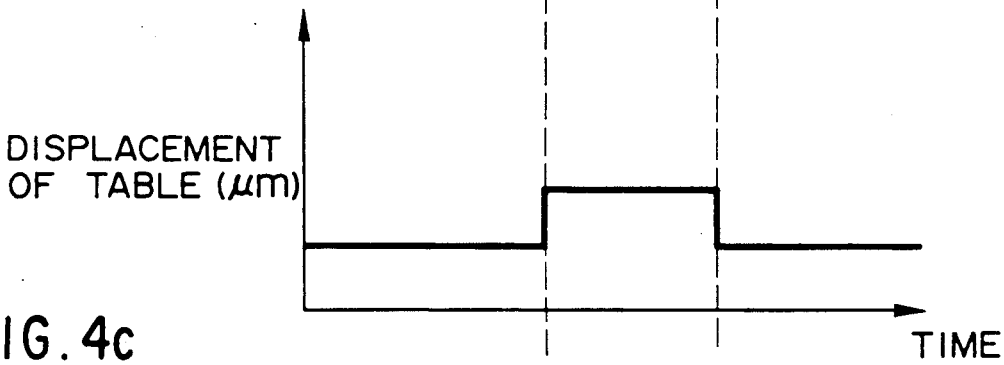
Figure 4D:
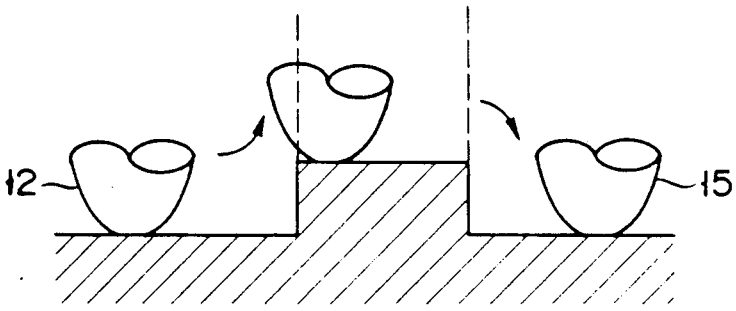

The load the tool 12 applies to the workpiece 15 is hence applied to the load cell 19 through the holder 14, the upper plate 13*a*, and the load-magnifying plate 13*c*, the piezoelectric ceramic member 20. The load cell 19 generates a voltage $V_1$ which changes with the load applied from the tool 12 to the workpiece 15 as is shown in FIG. 3. The comparator circuit 22 compares the voltage $V_1$ with the reference voltage $V_2$, and generates a signal showing the difference between these voltages, i.e., $V_1-V_2$. The difference signal is input to the proportional-plus-integral circuit 24. The circuit 24 processes the difference signal into a voltage signal which cancels out the difference $V_1-V_2$. This voltage signal is supplied to the drive circuit 25. The circuit 25 converts the voltage signal to a drive voltage $V_3$. The drive voltage $V_3$ is applied to the piezoelectric ceramic member 20. As a result, the piezoelectric ceramic member 20 contracts in its lengthwise direction, in accordance with the drive voltage $V_3$.

The difference $V_1-V_2$ increases as the load applied to the workpiece 15 increases, as is illustrated in FIG. 3. Therefore, the drive voltage $V_3$ output by the drive circuit 25 increases, and the piezoelectric ceramic member 20 further contracts in its lengthwise direction. Then, the load-magnifying plate 13*c* is bent in the direction of the arrow shown in FIG. 1, whereby the ball 17 moves downward, and so does the upper plate 13*a* of the table 13. As a result, the load applied to the workpiece 15 from the tool 12 decreases to the desired value.

When the tool 12 moves in contact with a stepped portion, if any, of the workpiece 15, the signal output from the load cell 19 and that of the signal input to the piezoelectric ceramic member 20 changes as is illustrated in FIG. 4. In other words, the load the tool 12 applies to the workpiece 15 changes as the tool 12 moves in contact with the stepped portion, the load cell 19 responds to the change in the polishing load, and a signal representing this change is supplied to the ceramic member 20 through the comparator circuit 22, the proportional-plus-integral circuit 24, and the drive circuit 25. As a result of this, the polishing load applied to the workpiece 15 from the tool 12 is automatically changed to the desired value. The table 13 thereby moves up and down, moving the tool 12 such that the work point thereof minutely moves along the complex curved surface of the workpiece 15. The tool 12, thus moved minutely, polishes the workpiece 15 with high precision.

As has been described, in the first embodiment of the invention, the piezoelectric ceramic member 20 is driven in accordance with the difference between the desired polishing load and the polishing load being applied from the tool 12 to the workpiece 15, thereby minutely moving the table 13 in the direction identical or opposite to the direction in which the tool 12 applies the load to the workpiece 15. Hence, the tool 12 applies the desired polishing load to the workpiece 15. In other words, since the table 13 moves up and down, thus moving the work point of the tool 12 along the peaks and depressions, if any, formed in the surface of the workpiece 15, whereby the tool 12 polishes the workpiece 15 with high precision. The changes in the load applied from the tool 12 to the workpiece 15, even if very small, can be detected with high accuracy since the polishing load is applied from the workpiece 15 directly to the table 13, then to the ceramic member 20, and further to the load cell 19. The signal output by the load cell 19 and representing the polishing load is supplied, as a control signal, to the piezoelectric ceramic member 20 through the polishing-load controller 21, whereby the tool 12 applies the desired polishing load to every part of the surface of the workpiece, polishing the workpiece with high precision in the order of nanometers.

Figure 5:
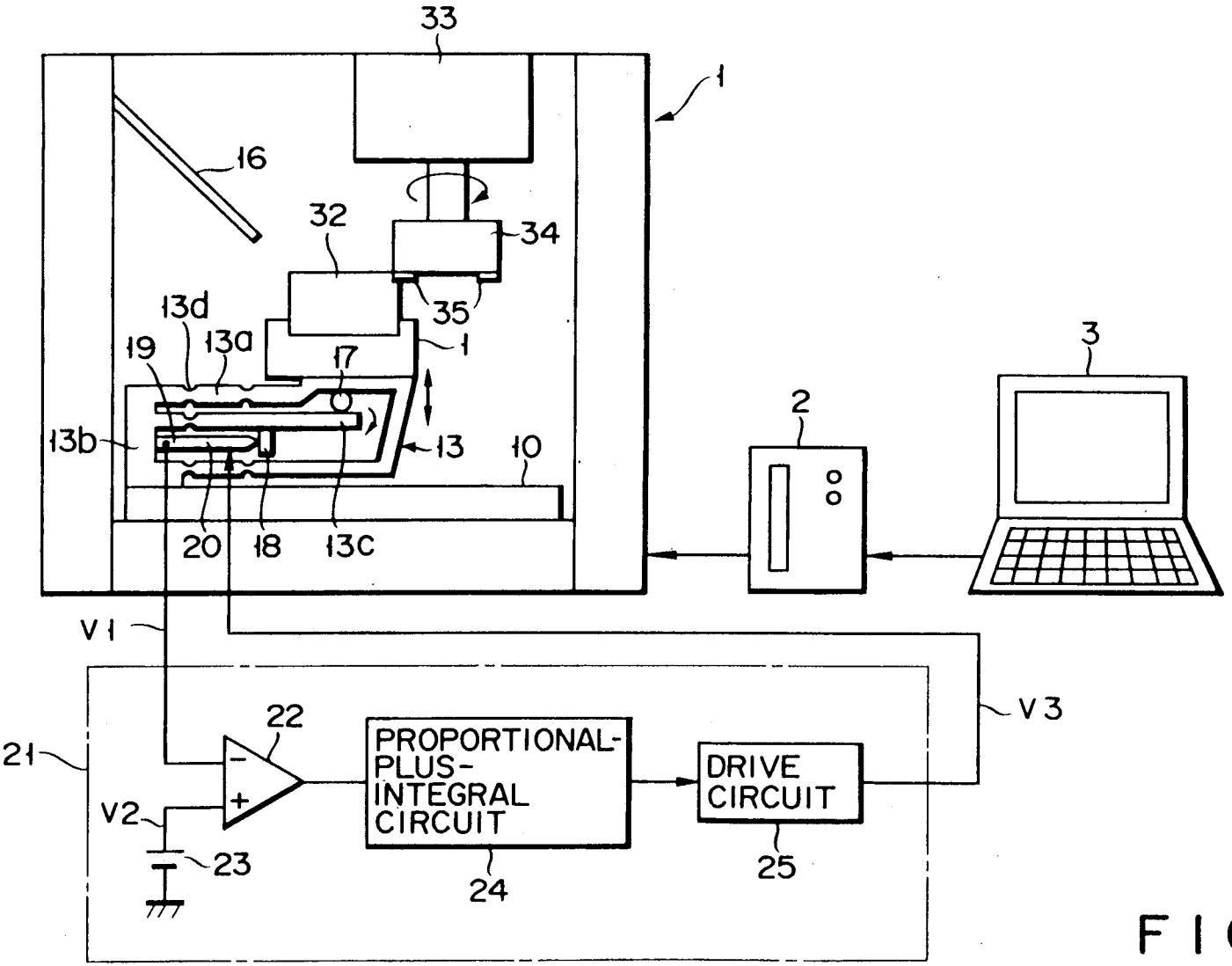
FIG. 5 is a front view showing a grinding apparatus, which is a second embodiment of the invention.

FIG. 5 illustrates a grinding apparatus, which is a second embodiment of the invention. In this figure, the same reference numerals are used to designate the same components as those shown in FIG. 1. As may be understood from FIG. 5, the grinding apparatus is identical to the apparatus shown in FIG. 1, except for the following points.

As is shown in FIG. 5, a bearing 33 is coupled to an electric motor (not shown) located above a workpiece 32. A cup-shaped grinding tool 34 is attached to the bearing 33. A grinding stone 35 is fastened to the tool 34. In operation, the grinding tool 34 applies a grinding load to the workpiece 32. In accordance with the grading load, a piezoelectric ceramic member 20 expands or contracts, thereby minutely moving a table 13 up or down, that is, in the direction opposite or identical to the direction in which the tool 34 is applying the grinding load to the workpiece 32. As a result of this, the load applied from the tool 34 to the workpiece 32 is changed to a predetermined, desired value.

The present invention is not limited to the embodiments described above. Changes and modifications may, therefore, be made without departing from the spirit or scope of the invention. For instance, the load cell 19 can be replaced by a strain gauge.

As has been described, the polishing apparatus according to the invention has a polishing tool, a table for holding a workpiece, a element for moving the table minutely, substantially in parallel to the direction identical or opposite to the direction in which the tool applies a load to a workpiece held by the table, and a detector for detecting the polishing load applied from the tool to the workpiece. The element is controlled in real time, in accordance with the load detected by the detector, thereby moving the table minutely such that the work point of the tool moves along the curved surface of the workpiece. As a result, the workpiece is polished with high precision.

What is claimed is:

1. A polishing apparatus comprising:

a tool for polishing a surface of a workpiece;

a table for supporting a workpiece and minutely movable in the same direction as, or the direction opposite to, the direction in which said tool applies a load to said workpiece;

electromechanical transducer means connected to said table, for minutely moving said table in accordance with an electric signal;

load-detecting means for detecting said load applied from said tool to said workpiece and generating an electric signal representing said load;

load-controlling means for controlling said electromechanical transducer means in accordance with said electric signal generated by said load-detecting means, said table comprising a substantially trapezoidal frame comprises of upper and lower plates each having first and second ends and functioning as a spring, and two side plates, one side plate interposed between said first ends of said upper and lower plates, and said other side plate interposed between said second ends of said upper and lower plates;

a load-magnifying plate located below said upper plate and functioning as a spring; and a ball interposed between said upper plate and said load-magnifying plate, said ball point-contacting both said upper plate and said load-magnifying plate.

2. The polishing apparatus according to claim 1, wherein said upper plate, said lower plate, and said load-magnifying plate have grooves, thereby functioning as springs.

3. The polishing apparatus according to claim 1, wherein said electromechanical transducer means is a piezoelectric element connected to said load-magnifying plate and said load-detecting means.

4. The polishing apparatus according to claim 3, wherein said load-detecting means is a load cell connected to said piezoelectric element.

5. The polishing apparatus according to claim 3, wherein said load-detecting means is a load cell.

6. The polishing apparatus according to claim 1, wherein said load-controlling means comprises a comparator circuit for comparing a prescribed load with the load detected by said load-detecting means, and generating a difference signal representing a difference between the loads, a proportional-plus-integral circuit for performing a proportional-plus-integral operation on the difference signal and generating an integration signal, and a drive circuit for drive said electromechanical transducer means in accordance with the integration signal.

7. A polishing apparatus comprising:

a tool for polishing a surface of a workpiece;

a holder for holding a workpiece to be polished;

a table supporting said holder and minutely movable in the same direction as, or the direction opposite to, the direction in which said tool applies a load to the workpiece, said table comprising a substantially trapezoidal frame comprised of upper and lower plates each having first and second ends and functioning as a spring, and two side plates, one interposed between the first ends of the upper and lower plates, and the other interposed between the second ends of said upper and lower plates, a load-magnifying plate located below said upper plate and functioning as a spring, and a ball interposed between said upper plate and said load-magnifying plate and point-contacting both said upper plate and said load-magnifying plate;

a piezoelectric element pressed onto the load-magnifying plate of said table;

a load detector connected to said piezoelectric element, for detecting the load applied from said tool to said workpiece; and load-controlling means comprising a comparator circuit for comparing a prescribed load with the load detected by said load-detector, and generating a difference signal representing a difference between the loads, a proportional-plus-integral circuit for performing a proportional-plus-integral operation on the difference signal and generating an integration signal, and a drive circuit for drive said electromechanical transducer means in accordance with the integration signal.

8. A grinding apparatus comprising;

a tool for grinding a surface of a workpiece;

a table for supporting said workpiece, said table being minutely movable alternatively in the same direction as, or the direction opposite to, the direction in which said tool applies said load to said workpiece, said table comprising a substantially trapezoidal frame comprised of upper and lower plates, said upper and lower plates each having first and second ends and functioning as a spring, and two side plates, one side plate interposed between the first ends of said upper and lower plates, and said other side plate interposed between said second ends of said upper and lower plates;

a load-magnifying plate located below said upper plate and functioning as a spring;

a ball-interposed between said upper plate and said load-magnifying plate and point-contacting both said upper plate and said load-magnifying plate;

electromechanical transducer means for moving said table minutely;

load-detecting means for detecting said load applied from said tool to said workpiece; and load-controllng means for controlling said electromechanical transducer means in accordance with said load detected by said load-detecting means.

* * * * *